US012024876B2

(12) United States Patent
Krause

(10) Patent No.: US 12,024,876 B2
(45) Date of Patent: Jul. 2, 2024

(54) SPLICE APPARATUS FOR JOINING TOGETHER ADJACENT WALL BRACKETS

(71) Applicant: Advanced Architectural Products, LLC, Allegan, MI (US)

(72) Inventor: G. Matt Krause, Allegan, MI (US)

(73) Assignee: Advanced Architectural Products, LLC, Allegan, MI (US)

( * ) Notice: Subject to any disclaimer, the term of this patent is extended or adjusted under 35 U.S.C. 154(b) by 121 days.

(21) Appl. No.: 17/385,509

(22) Filed: Jul. 26, 2021

(65) Prior Publication Data

US 2022/0025642 A1 Jan. 27, 2022

Related U.S. Application Data

(60) Provisional application No. 63/056,607, filed on Jul. 25, 2020.

(51) Int. Cl.
*E04B 1/58* (2006.01)
*E04B 1/38* (2006.01)

(52) U.S. Cl.
CPC ..... *E04B 1/388* (2023.08); *E04B 2001/389* (2023.08)

(58) Field of Classification Search
CPC .... E04B 1/40; E04B 1/5831; E04B 2001/405; E04B 2001/5856; E04G 17/00
USPC ..... 248/558
See application file for complete search history.

(56) References Cited

U.S. PATENT DOCUMENTS 4,286,410 A * 9/1981 Hahn ..... E06B 7/231 404/47
4,570,408 A * 2/1986 Frascaroli ..... E04B 1/5831 52/843
5,015,117 A * 5/1991 Pawlicki ..... E04G 17/00 249/7
5,144,780 A * 9/1992 Gieling ..... F16B 7/04 52/298
5,813,174 A * 9/1998 Waller ..... E04H 9/06 109/78
7,946,091 B1 * 5/2011 Wisniewski ..... H02G 3/123 220/3.9
8,522,498 B2 * 9/2013 Picken ..... E04F 19/062 52/287.1
9,366,022 B2 * 6/2016 Frey ..... E04B 1/5831
9,416,529 B1 * 8/2016 Jeske ..... E04B 2/88
9,441,359 B1 * 9/2016 Hsieh ..... E04B 1/3483

(Continued)

*Primary Examiner* — Nkeisha Smith
(74) *Attorney, Agent, or Firm* — Jovan N. Jovanovic; The Watson IP Group, PLC

(57) ABSTRACT

A method, system and splice apparatus comprise a first wall bracket to couple to a first support member. A second wall bracket is coupled to a second support member, the first and second wall brackets comprising a composite material. A splice apparatus includes a first end, a second end, a first side, and a second side on an opposite side of the splice apparatus from the first side of the splice apparatus, the first end of the splice apparatus disposed proximate to a second end of the first wall bracket and the second end of the splice apparatus disposed proximate to a first end of the second wall bracket. The splice apparatus is fastened to at least one of the first wall bracket and the second wall bracket to maintain substantial alignment of the first wall bracket with the second wall bracket.

11 Claims, 4 Drawing Sheets

(56) References Cited

U.S. PATENT DOCUMENTS

| | | | | |
|---|---|---|---|---|
| 9,663,943 | B2 * | 5/2017 | Dimakis | E04B 1/26 |
| 10,538,913 | B2 * | 1/2020 | Matthai | E04B 2/7407 |
| 11,255,119 | B2 * | 2/2022 | Krause | E06B 1/003 |
| 2016/0115683 | A1 * | 4/2016 | Miller | E04B 5/29 52/702 |
| 2017/0233996 | A1 * | 8/2017 | Abernathy | F16B 7/182 52/698 |
| 2019/0191872 | A1 * | 6/2019 | Dreher | E04B 2/7437 |
| 2023/0017313 | A1 * | 1/2023 | Meether | E04B 1/40 |

* cited by examiner

SPLICE APPARATUS FOR JOINING TOGETHER ADJACENT WALL BRACKETS

CROSS-REFERENCE TO RELATED APPLICATION

This present application claims priority from U.S. Provisional Patent Application Ser. No. 63/056,607, filed on Jul. 25, 2020, entitled "SPLICE APPARATUS FOR JOINING TOGETHER ADJACENT WALL BRACKETS", the entire specification of which is hereby incorporated by reference in its entirety.

BACKGROUND OF THE DISCLOSURE

1. Field of the Disclosure

The disclosure relates in general to wall brackets, and more particularly, to a splice apparatus for joining together adjacent wall brackets.

2. Background Art

Various types of wall brackets are used within the construction industry, some of which are commonly referred to as girts. Amongst others, some such wall brackets are increasingly being made form polymer-based materials. For example, certain constructions of wall brackets are formed from a plurality of fibers embedded within a resin matrix. Unlike traditional metal wall brackets, these composite type brackets have differing properties which pose different installation and loading challenges. Furthermore, the relative expansion between other components, some of which comprise metals and the like when compared to such composites can provide additional challenges. In many instances, such installations, have elements that are cantilevered and that have loadings that are cantilever.

SUMMARY OF THE DISCLOSURE

The disclosure is directed a system comprising a first wall bracket, a second wall bracket, and a splice apparatus. The first wall bracket includes a first end, a second end, a first side, and a second side on an opposite side of the first wall bracket from the first side, the first wall bracket to couple to a first support member. The second wall bracket includes a first end, a second end, a first side, and a second side on an opposite side of the second wall bracket from the first side of the second wall bracket, the second wall bracket to couple to a second support member, the first and second wall brackets comprising a composite material. The splice apparatus includes a first end, a second end, a first side, and a second side on an opposite side of the splice apparatus from the first side of the splice apparatus, the first end of the splice apparatus disposed proximate to the second end of the first wall bracket and the second end of the splice apparatus disposed proximate to the first end of the second wall bracket. The splice apparatus is fastened to at least one of the first wall bracket and the second wall bracket to maintain substantial alignment of the first wall bracket with the second wall bracket.

In some configurations, the first and second wall brackets comprise an upper member, a lower member, and an intermediate member perpendicularly coupled to the upper member and the lower member.

In some configurations, the spice apparatus comprises an upper member that corresponds to the upper member of the first and second wall brackets, an intermediate member that corresponds to the intermediate member of the first and second wall brackets, and a lower member that corresponds to the lower member of the first and second wall brackets, the upper member, and intermediate member, and the lower member of the splice apparatus being coupled to wrap around an entire perimeter of the first and second wall brackets.

In some configurations, the spice apparatus comprises a first "L shaped portion, a second "L" shaped portion, and a straight portion perpendicularly coupled to the first "L shaped portion and a second "L" shaped portion, the splice apparatus shaped to slide under and against the first and second wall brackets when disposed adjacent.

In some configurations, the spice apparatus comprises a first curved portion, a second curved portion, and a straight portion coupled to the first curved portion and the second curved portion, the splice apparatus to slide onto the upper member of the first and second wall brackets without substantial space therebetween.

In some configurations, the spice apparatus comprises a first curved portion, a second curved portion, and a straight portion coupled to the first curved portion and the second curved portion, the splice apparatus to slide onto the lower member of the first and second wall brackets without substantial space therebetween.

In some configurations, the splice apparatus is rectangular in shape and coupled to at least one of the upper member, the lower member, and the intermediate member perpendicularly coupled to the upper member and the lower member.

In some configurations, the splice apparatus comprises at least one of aluminum and a composite material.

The disclosure is also directed to a method of maintaining substantial alignment of a first wall bracket with a second wall bracket via a splice apparatus. The method comprises coupling the first wall bracket to a first support member, the first wall bracket including a first end, a second end, a first side, and a second side on an opposite side of the first wall bracket from the first side, the first wall bracket to couple to a first support member. The method further comprises coupling the second wall bracket to a second support member, the second wall bracket including a first end, a second end, a first side, and a second side on an opposite side of the second wall bracket from the first side of the second wall bracket, the second wall bracket to couple to a second support member, the first and second wall brackets comprising a composite material. The method even further comprises fastening a splice apparatus to at least one of the first wall bracket and the second wall bracket to maintain substantial alignment of the first wall bracket with the second wall bracket, the splice apparatus includes a first end, a second end, a first side, and a second side on an opposite side of the splice apparatus from the first side of the splice apparatus, the first end of the splice apparatus disposed proximate to the second end of the first wall bracket and the second end of the splice apparatus disposed proximate to the first end of the second wall bracket.

In some configurations of the method, the first and second wall brackets comprise an upper member, a lower member, and an intermediate member perpendicularly coupled to the upper member and the lower member.

In some configurations of the method, the spice apparatus comprises an upper member that corresponds to the upper member of the first and second wall brackets, an intermediate member that corresponds to the intermediate member of the first and second wall brackets, and a lower member that corresponds to the lower member of the first and second wall brackets, the upper member, and intermediate member, and the lower member of the splice apparatus being coupled to wrap around an entire perimeter of the first and second wall brackets.

In some configurations of the method, the spice apparatus comprises a first "L shaped portion, a second "L" shaped portion, and a straight portion perpendicularly coupled to the first "L shaped portion and a second "L" shaped portion, the splice apparatus shaped to slide under and against the first and second wall brackets when disposed adjacent.

In some configurations of the method, the spice apparatus comprises a first curved portion, a second curved portion, and a straight portion coupled to the first curved portion and the second curved portion, the splice apparatus to slide onto the upper member of the first and second wall brackets without substantial space therebetween.

In some configurations of the method, the spice apparatus comprises a first curved portion, a second curved portion, and a straight portion coupled to the first curved portion and the second curved portion, the splice apparatus to slide onto the lower member of the first and second wall brackets without substantial space therebetween.

In some configurations of the method, the splice apparatus is rectangular in shape and coupled to at least one of the upper member, the lower member, and the intermediate member perpendicularly coupled to the upper member and the lower member.

The disclosure is also directed to a splice apparatus comprising a first end, a second end, a first side, and a second side. The second side is disposed on an opposite side of the splice apparatus from the first side of the splice apparatus, with the first end of the splice apparatus to be disposed proximate to a second end of a first wall bracket and a second end of the splice apparatus to be disposed proximate to the first end of the second wall bracket. The first wall bracket includes a first end, the second end, a first side, and a second side on an opposite side of the first wall bracket from the first side, the first wall bracket to couple to a first support member. The second wall bracket includes a first end, the second end, a first side, and a second side on an opposite side of the second wall bracket from the first side of the second wall bracket, the second wall bracket to couple to a second support member, the first and second wall brackets comprising a composite material.

In some configurations of the splice apparatus, wherein the first and second wall brackets comprise an upper member, a lower member, and an intermediate member perpendicularly coupled to the upper member and the lower member. The spice apparatus comprises an upper member that corresponds to the upper member of the first and second wall brackets, an intermediate member that corresponds to the intermediate member of the first and second wall brackets, and a lower member that corresponds to the lower member of the first and second wall brackets, the upper member, and intermediate member, and the lower member of the splice apparatus being coupled to wrap around an entire perimeter of the first and second wall brackets In some configurations of the splice apparatus, wherein the first and second wall brackets comprise an upper member, a lower member, and an intermediate member perpendicularly coupled to the upper member and the lower member. The splice apparatus comprises a first "L shaped portion, a second "L" shaped portion, and a straight portion perpendicularly coupled to the first "L shaped portion and a second "L" shaped portion, the splice apparatus shaped to slide under and against the first and second wall brackets when disposed adjacent.

In some configurations of the splice apparatus, wherein the first and second wall brackets comprise an upper member, a lower member, and an intermediate member perpendicularly coupled to the upper member and the lower member. The spice apparatus comprises a first curved portion, a second curved portion, and a straight portion coupled to the first curved portion and the second curved portion, the splice apparatus to slide onto the upper member of the first and second wall brackets without substantial space therebetween.

In some configurations of the splice apparatus, the splice apparatus is rectangular in shape and coupled to at least one of the upper member, the lower member, and the intermediate member perpendicularly coupled to the upper member and the lower member.

BRIEF DESCRIPTION OF THE DRAWINGS

The disclosure will now be described with reference to the drawings wherein.

DETAILED DESCRIPTION OF THE DISCLOSURE

Figure 1:
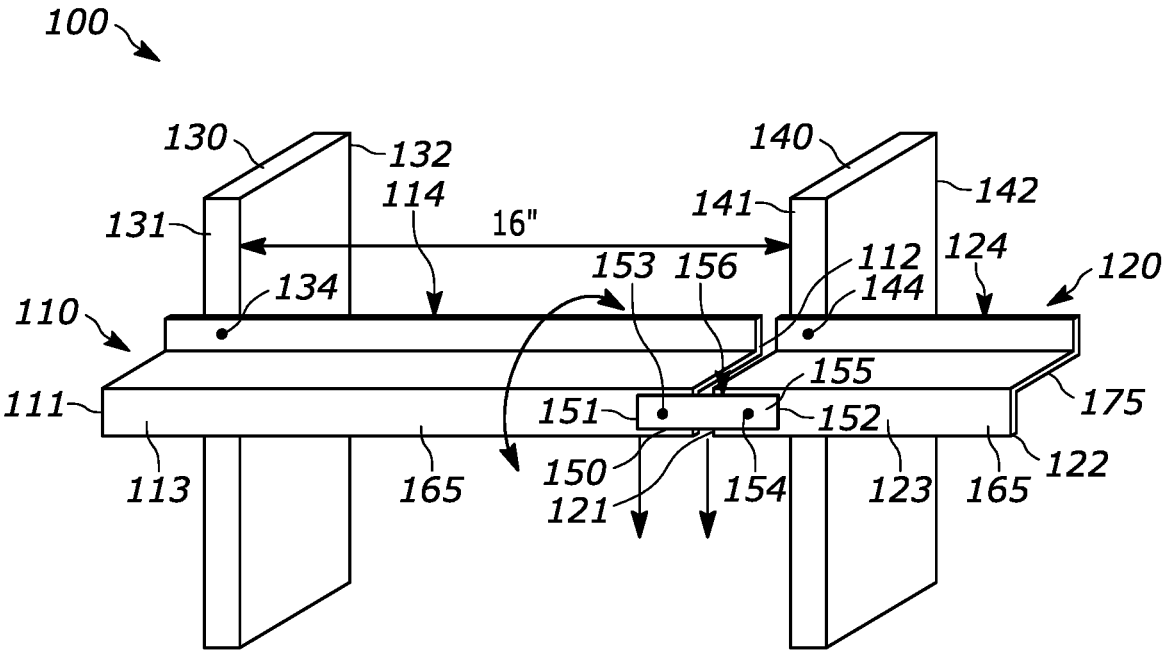
FIG. 1 illustrates an example apparatus for maintaining alignment of a first wall bracket with a second wall bracket, in accordance with at least one configuration disclosed herein.

While this disclosure is susceptible of configuration in many different forms, there is shown in the drawings and described herein in detail a specific configuration(s) with the understanding that the present disclosure is to be considered as an exemplification and is not intended to be limited to the configuration(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, a system 100 is disclosed that includes a first wall bracket 110, a second wall bracket 120, and a splice apparatus 150. Generally, with the configurations contemplated, the first and second wall brackets comprise a substantially if not fully composite material formed from fibers embedded within a resin matrix. The fibers can be of the type that are arranged singularly, in fiber tows or which may comprise woven fabrics of fibers. The fibers may comprise glass fibers, carbon fibers, aramid fibers, Kevlar fibers and combinations of these, among others. Typically, such a wall bracket is coupled to a substrate which may be a sheet material backed by studs or the like, such as first support member 130 and second support member 140, which are often spaced, at, for example a foot, sixteen, eighteen and/or twenty-four inches on center (merely exemplary and not to be deemed limiting). In some configurations such support members may be of wood or may be formed from a metal stamping. In still other configurations, composites may be utilized among other materials. On the opposite side thereof, the wall bracket can be attached to a cladding, which may comprise a sheet material, such as a sheet metal, a stone, or other masonry, stucco, wood, among other solutions. Often times, an insulation is positioned in the space between the cladding and the substrate along with, optionally, vapor barriers and the like.

Problematically, in many of the installations, wall brackets are desired to be continuous from end to end (in a horizontal configuration, for example, and without limitation). Yet, in many installations, a support member does not align with the end of a wall bracket, and, as such, at least a portion of the wall bracket is cantilevered and extends beyond a support member. It will also be understood that, typically, codes require a one inch spacing of a fastener from the end of the bracket when coupled to a support member, and, as such, it is often not possible to have wall brackets meet at a support member, wherein both are attached to the support member simultaneously and side by side (typically, the support member does not have sufficient width for such a coupling). Thus, rotational and pulling forces are experienced by the portion of the wall bracket that is cantilevered.

In the present disclosure, the first wall bracket 110 includes a first end 111, a second end 112, a first side 113, and a second side 114 on an opposite side of the first wall bracket 110 from the first side 113 of the first wall bracket 110. During use, the first wall bracket 110 is coupled to a first support member 130 that includes a front edge 131 and a back edge 132. The second side 114 of the first wall bracket 110 is typically coupled to the front edge 131 of the first support member 130 via a first fastener 134, e.g., a screw. In some configurations, these wall brackets 110, 120 take the form of a girt, or a sheeting rail, onto which a construction material is attached thereto, such as an insulation material.

The second wall bracket 120 likewise includes a first end 121, a second end 122, a first side 123, and a second side 124 on an opposite side of the second wall bracket 120 from the first side 123 of the first wall bracket 120. During use, the second wall bracket 120 is coupled to a second support member 140 that includes a front edge 141 and a back edge 142. The second side 124 of the second wall bracket 120 is typically coupled to the front edge 141 of the second support member 140 via a second fastener 144, e.g., a screw. Although single fasteners 134, 144 are shown as being used to couple the first wall bracket 110 to the first support member 130 and the second wall bracket 120 to the second support member 140, respectively, additional fasteners can be used to couple the first wall bracket 110 to the first support member 130 and/or the second wall bracket 120 to the second support member 140, without departing from the scope of the configuration(s).

Typically, the first support member 130 is spaced apart from the second support member 140 by a distance dictated by building codes, such as sixteen inches apart on center. It will be understood that it is desirable for the wall bracket to extend an inch beyond the support member, preferably, and, as such, for an example wherein the support members are sixteen inches on center, one wall bracket may extend by an inch whereas the other bracket extends beyond the adjoining support by close to fifteen inches. In other configurations, each wall bracket may extend beyond the last support by eight inches in the example provided.

Typically, to form a proper insulative system, it is desirable that the wall bracket be formed from a polymer material, or a fiber reinforced resin. Typically, the entirety of the bracket is formed from such a material through, for example, a pultrusion process or a casting process. In some instances, metal supports may be attached or embedded to certain of the walls of the bracket, whereas in other configurations, the entire wall bracket is formed from a composite.

The splice apparatus 150 includes a first end 151, a second end 152, a first side 155, and a second side 156 on an opposite side of the splice apparatus 150 form the first side 155 of the splice apparatus 150. The first end 151 of the splice apparatus 150 is disposed proximate to the second end 112 of the first wall bracket 110, and the second end 152 of the splice apparatus 150 is disposed proximate to the first end 121 of the second wall bracket 120. The second side 156 of the splice apparatus 150 is coupled to the xxx. The splice apparatus 150 can be coupled, via at least one of a third fastener 153 and a fourth fastener 154, to any of flat surfaces on at least one of the first wall bracket 110 and the second wall bracket 120. Once so coupled, the splice apparatus 150 maintains substantial alignment (+−10% width of the wall bracket) of the second end 112 of the first wall bracket 110 with the first end 121 of the second wall bracket 120.

In at least one configuration, the splice apparatus 150 (shown in more detail in FIG. 3) can be a rectangular configuration with its long axis, its length L, running with a long axis of the first and second wall brackets 110, 120, and its height H running with a short axis of a lower member 203 (FIG. 2), as shown, although other shapes are possible. In other configurations, the splice apparatus 150 can be differently configured, with other configurations of a splice apparatus shown in FIGS. 5-8, discussed in detail below. In at least one configuration, a system 200 shown in FIG. 2 can include use of more than one splice apparatus 150 to maintain alignment of the first wall bracket 110 with the second wall bracket 120. For example, each of the first and second wall brackets 110, 120 can each include an upper member 201 that is coupled to the first and second wall brackets 110, 120, respectively, as discussed above. Each of the first and second wall brackets 110, 120 also includes an intermediate member 202 that is perpendicular coupled at one end thereof to the upper member 201 and to the lower member 203 on the other end thereof, the upper member 201 extending upward from one end of the intermediate member 202 and the lower member 203 extending downward from an opposite end of the intermediate member 202, as shown.

Figure 2:
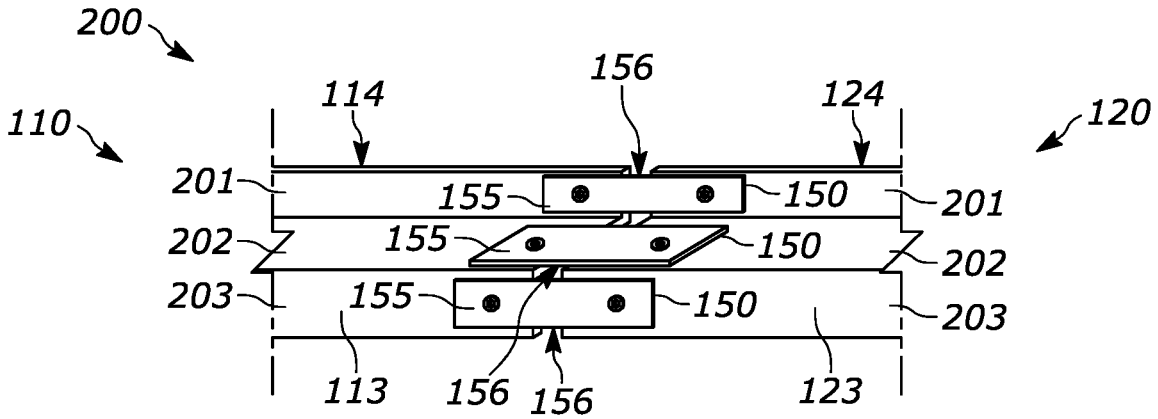
FIG. 2 illustrates an example system including use of a plurality of splice apparatuses to maintain alignment of a first wall bracket with a second wall bracket, in accordance with at least one configuration disclosed herein.
Figure 3:
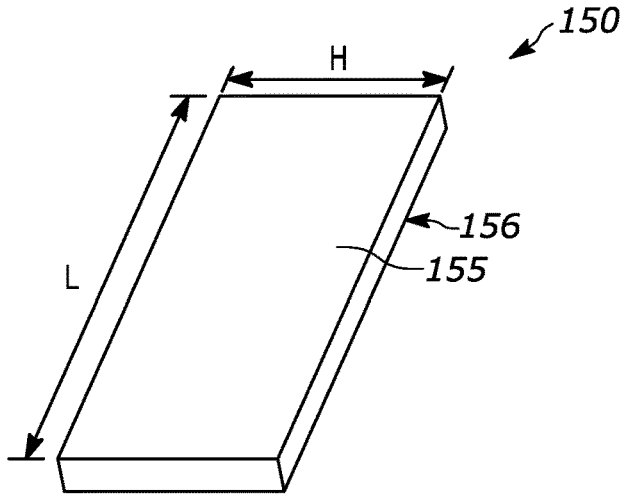

In the configuration shown, the upper member 201 is perpendicularly coupled to the intermediate member 202, and the intermediate member 202 is perpendicularly coupled to the lower member 203, the upper member 201 and the lower members 203 being approximately (+−5 degrees) parallel to each other. In this configuration, a first splice apparatus 150 can be used to couple the upper members 201 of the first and second wall brackets 110, 120, a second splice apparatus 150 can be used to couple the intermediate members 202 for the first and second wall brackets 110, 120, and a third splice apparatus 150 can be used to couple the lower members 203 of the first and second wall brackets 110, 120. Although three splice apparatus 150 are shown in FIG. 2, in an alternate configuration, only two splice apparatus 150 are used to couple the first and second wall brackets 110, 120, two of either the first, second, and third splice apparatus 150 shown. Additionally, although the splice apparatus(es) 150 is/are shown as being disposed on an outside surface 165 of the first and second wall brackets 110, 120, in an alternate configuration at least one splice apparatus 150 can be disposed on an inside surface 175 of the first and second wall brackets 110, 120, without departing from the scope of the configuration(s).

Figure 4:
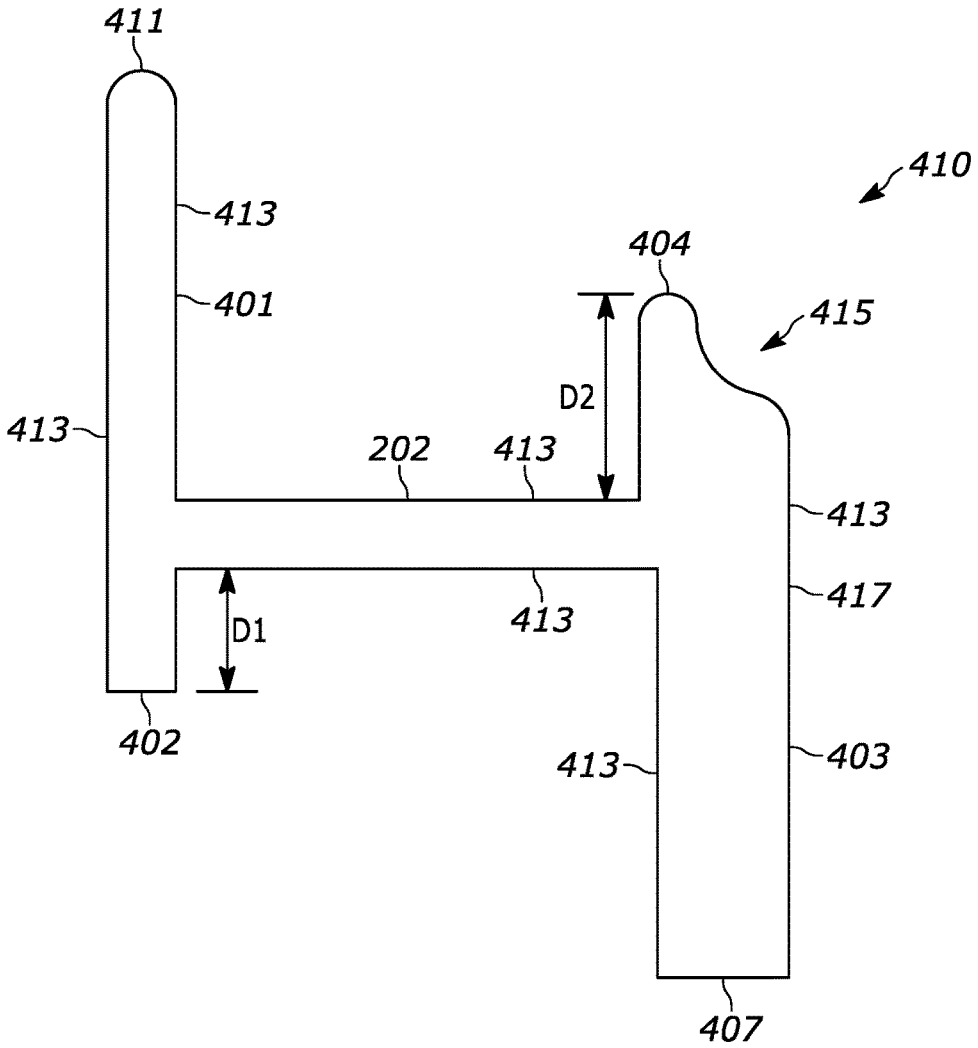
FIG. 4 illustrates another example wall bracket for use with a splice apparatus, in accordance with at least one configuration disclosed herein.

With reference to FIG. 4, a cross section of an alternative configuration wall bracket 410 is shown that changes a location at which the intermediate member 202 is coupled to an upper member and to a lower member 403. In at least one configuration, the ends of the upper member 401 are rounded, as shown, although square edges are possible. As shown in FIG. 1 for the wall brackets 110, 120, the upper member 401 is coupled to the intermediate member 202 at ends thereof, respectively. In the alternate configuration shown in FIG. 4, the intermediate member 202 is instead coupled to the upper member 401 at a distance D1 from a bottom end 402 of the upper member 401. Similarly, the lower member 403 is coupled to the intermediate member 403 at a distance D2 from a top end 404 of the lower member 403. The wall bracket 410 also includes a soft ledge 415 disposed at the top end 404 of the lower member 403, the soft ledge 415 facing towards an outside edge 417 of the lower member 403. The wall bracket 410 further includes an outside surface 413. In at least one configuration, a bottom 407 of the lower member 403 includes rounded corners, as shown.

Figure 5:
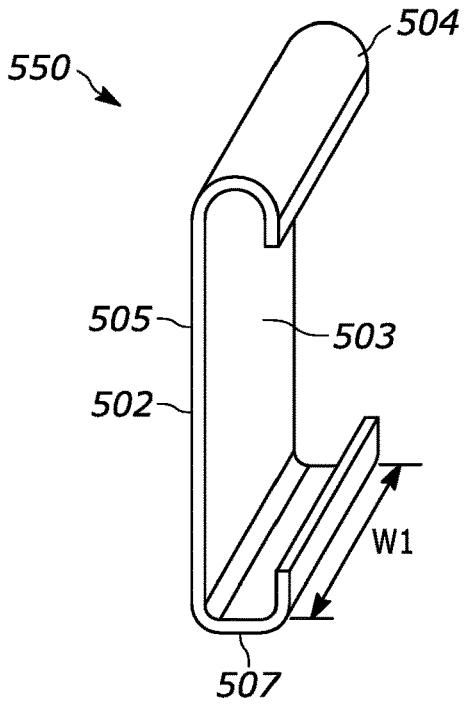
FIG. 5 illustrates another example splice apparatus for use with the wall bracket shown in FIG. 4, in accordance with at least one configuration disclosed herein.

FIG. 5 illustrates another splice apparatus 550. The splice apparatus 650, instead of being configured to be coupled to a flat surface of the first and second wall brackets 110, 120, as described above, the splice apparatus 550 instead is configured to slide onto the upper member 401. As such, the splice apparatus 550 includes a straight portion 502 that corresponds to the length of the upper member 401 of the wall bracket 410. The splice apparatus 550 further includes a first curved portion 504 disposed at and coupled to a top of the straight portion 502, the first curved portion 504 being shaped to follow a shape of a top end 411 of the upper member 401. Likewise, a second curved portion 507 is disposed at and coupled to a bottom of the straight portion 502 and is shaped to follow a shape of the bottom end 402 of the upper member 401. The splice apparatus 550 further includes an inside surface 503 and an outside surface 505. The splice apparatus 550 is sized and shaped to allow the splice apparatus 550 to slide onto the upper member 401 without substantial space therebetween, from an end of the wall bracket 410, with the inside surface 503 of the splice apparatus 550 at least substantially contacting the upper member 401.

During use, the splice apparatus 550 is slid about (+−20%) halfway of its width W1 onto a first upper member 401, and then a second upper member 410 is slid into the other half of the width W1 of the splice apparatus 550, the splice apparatus 550 bridging a gap between two such upper members 401. In at least one configuration, at least one fastener can be used to fasten the splice apparatus 550 together with at least one of these two wall brackets 410. Because the splice apparatus 550 is coupled to the first and second wall brackets 410 by virtue of its size and shape corresponding to the shame of the upper member 401, in at least one configuration only a single fastener can be used to couple the splice apparatus 550 to one of the first and second wall brackets 410, the fastener being used to prevent the splice apparatus 550 from moving from the gap between the first and second wall brackets 410.

Figure 6:
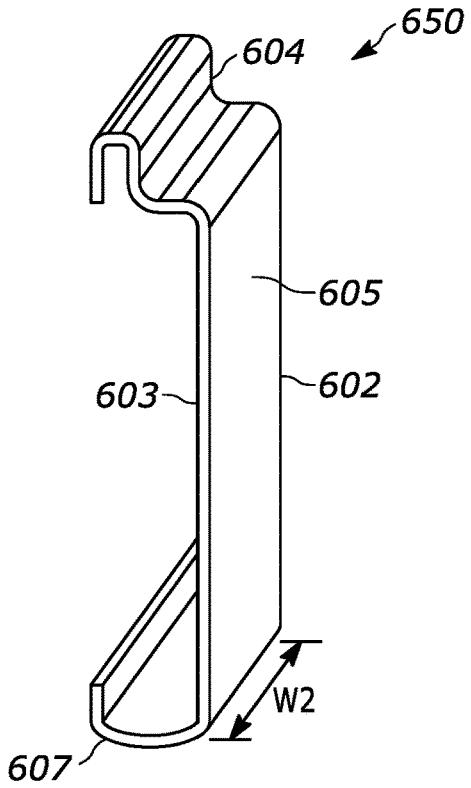
FIG. 6 illustrates yet another example splice apparatus for use with the wall bracket shown in FIG. 4, in accordance with at least one configuration disclosed herein.

FIG. 6 illustrates yet another splice apparatus 650. The splice apparatus 650, instead of being configured to be coupled to a flat surface of the first and second wall brackets 110, 120, as described above, the splice apparatus 650 instead is configured to slide onto the lower member 403. As such, the splice apparatus 650 includes a straight portion 602 that corresponds to the length of the lower member 403 of the wall bracket 410. The splice apparatus 650 further includes a first curved portion 604 disposed at and coupled to a top of the straight portion 602. The first curved portion 604 is shaped to follow a shape of a top end 404 of the lower member 403. Likewise, a second curved portion 607 is disposed at and coupled to a bottom of the straight portion 602 and is shaped to follow a shape of the bottom end 407 of the lower member 403. The splice apparatus 650 further includes an inside surface 603 and an outside surface 605. The splice apparatus 650 is sized and shaped to allow the splice apparatus 650 to slide onto the lower member 403 without substantial space therebetween, from an end of the wall bracket 410, with the inside surface 603 of the splice apparatus 650 at least substantially contacting the lower member 403.

During use, the splice apparatus 650 is slid about (+−20%) half of its width W2 onto a first lower member 403, and then a second lower member 403 is slid into the other half of the width W2 of the splice apparatus 650, the splice apparatus 650 bridging a gap between two such lower members 603. In at least one configuration, at least one fastener can be used to fasten the splice apparatus 650 together with at least one of these two wall brackets 410. Because the splice apparatus 650 is coupled to the first and second wall brackets 410 by virtue of its shape corresponding to the shame of the lower member 403, in at least one configuration only a single fastener can be used to couple the splice apparatus 650 to one of the first and second wall brackets 410, the fastener being used to prevent the splice apparatus 650 from moving from the gap between the first and second wall brackets 410.

Figure 7:
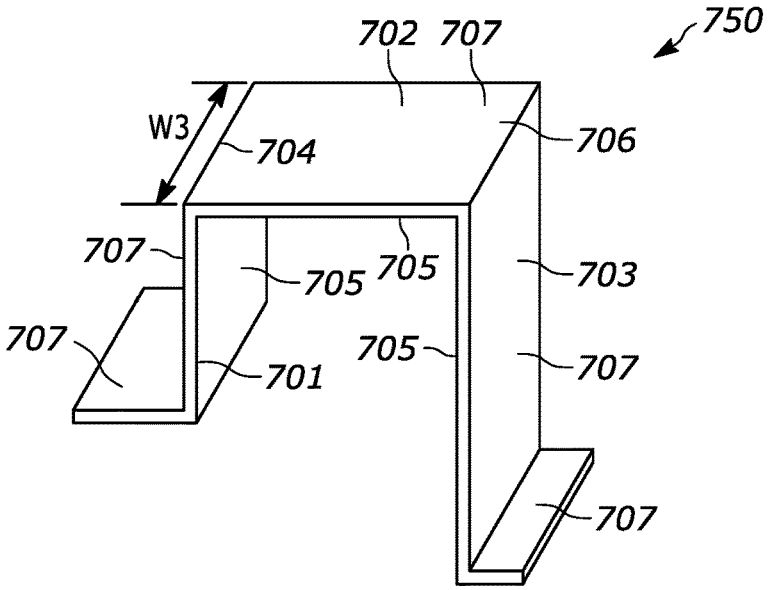
FIG. 7 illustrates even yet another example splice apparatus for use with the wall bracket shown in FIG. 4, in accordance with at least one configuration disclosed herein.

FIG. 7 illustrates yet another splice apparatus 750. The splice apparatus 750, instead of being configured to be coupled to a flat surface of the first and second wall brackets 110, 120, as described above, the splice apparatus 750 instead is configured to slide under the wall bracket 410, contacting all three of the upper member 401, the intermediate member 403, and the lower member 403. As such, the splice apparatus 750 includes a straight portion 702 that corresponds to a length of the intermediate member 202 of the wall bracket 410. The splice apparatus 750 further includes a first "L" shaped portion disposed at and perpendicularly coupled at a first end 704 of the straight portion 702. The first "L" shaped portion 604 is shaped to follow a shape of the bottom end 402 of the upper member 401. Likewise, a second "L" shaped portion 703 is disposed at and perpendicularly coupled at a second end 706 of the straight portion 702 and is shaped to follow a shape of the bottom end 407 of the lower member 403. The splice apparatus 750 further includes an inside surface 705 and an outside surface 707. The splice apparatus 750 is sized to allow the splice apparatus 750 to slide under and against two adjacent wall brackets 410 without substantial space therebetween, with the outside surface 705 of the splice apparatus 750 at least substantially contacting the wall bracket 410 with portions thereof that follow shapes of the wall bracket 410.

During use, the splice apparatus 750 is slid so that about (+−20%) half of its width W3 is disposed under an end of a first wall bracket 410, and the other half of its width W3 is disposed under another end of a second wall bracket 410, the splice apparatus 750 bridging a gap between two such wall brackets 410. In at least one configuration, at least one fastener can be used to fasten the splice apparatus 750 together with at least one of these two wall brackets 410. Because the splice apparatus 750 is coupled to the first and second wall brackets 410 by virtue of its shape corresponding to the shame of the first and second wall brackets 410, in at least one configuration only a single fastener can be used to couple the splice apparatus 750 to one of the first and second wall brackets 410, the fastener being used to prevent the splice apparatus 750 from moving from the gap between the first and second wall brackets 410.

Figure 8:
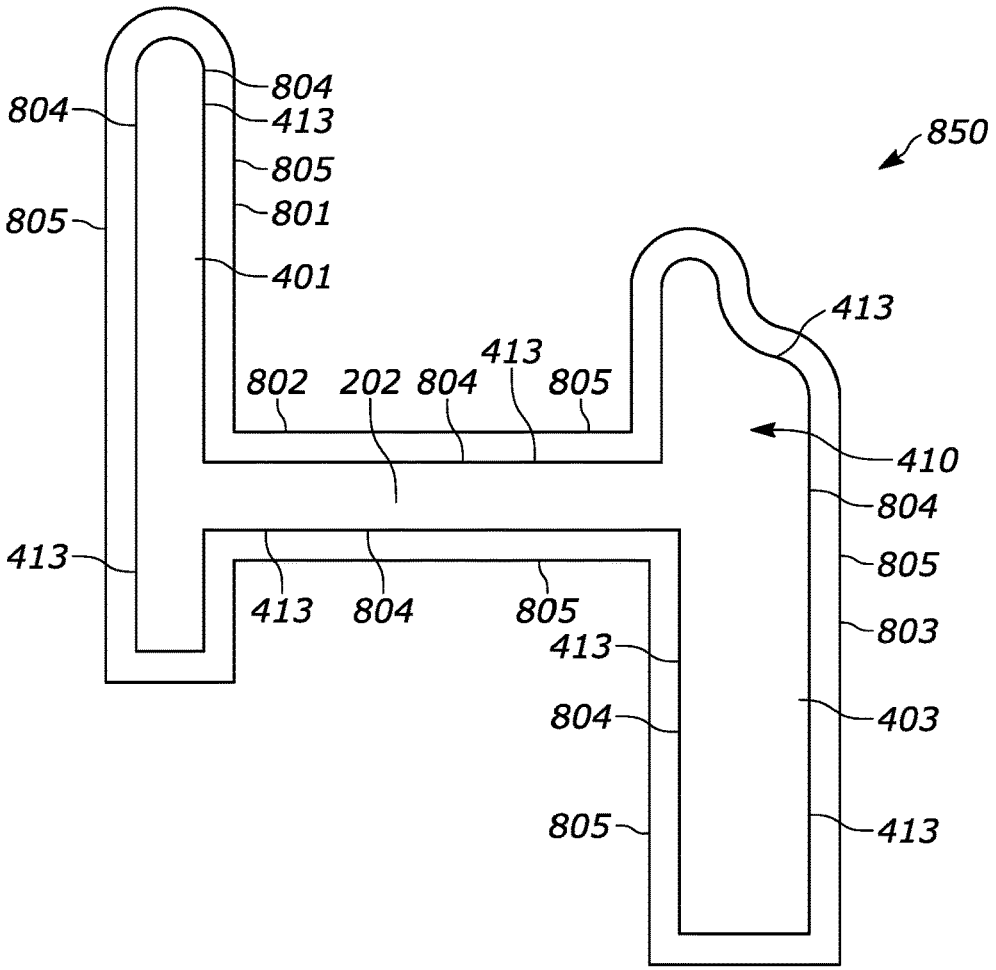
FIG. 8 illustrates one more example splice apparatus for use with the wall bracket shown in FIG. 4, in accordance with at least one configuration disclosed herein.

FIG. 8 illustrates yet another splice apparatus. The splice apparatus 850, instead of being configured to be coupled to a flat surface of the first and second wall brackets 110, 120 or to slide under the wall bracket 410, as described above, the splice apparatus 750 instead is configured to wrap around an entire perimeter or profile of the wall bracket 410, such that the splice apparatus 850 has an opening therein to allow it to slide onto an end of the wall bracket 410. As such, the splice apparatus 850 includes an upper member 801 that corresponds to the upper member 401 of the wall bracket 410. The splice apparatus 850 further an intermediate member 802 that corresponds to the intermediate member 202 of the wall bracket 410 and a lower member 803 that corresponds to the lower member 403 of the wall bracket 410. The splice apparatus 850 further includes an inside surface 804 and an outside surface 805, the inside surface 804 of the splice apparatus 850 at least substantially contacting the outside surface 413 of the wall bracket 410.

During use, the splice apparatus 850 is slid so that about (+−20%) half of its width is disposed onto an end of a first wall bracket 410 without substantial space therebetween, and the other half of its width is slid onto an end of a second wall bracket 410 without substantial space therebetween, the splice apparatus 850 bridging a gap between two such wall brackets 410. In at least one configuration, at least one fastener can be used to fasten the splice apparatus 850 together with at least one of these two wall brackets 410. Because the splice apparatus 850 is coupled to the first and second wall brackets 410 by virtue of its shape corresponding to the shame of the first and second wall brackets 410, in at least one configuration only a single fastener can be used to couple the splice apparatus 850 to one of the first and second wall brackets 410, the fastener being used to prevent the splice apparatus 850 from moving from the gap between the first and second wall brackets 410.

In at least one configuration, the splice apparatuses 150, 550, 650, 750, 850 are approximately (+−10%) 4-6" long, and constructed from aluminum and/or composite material, such as the same composite material from which the wall brackets 110, 120, 410 are manufactured. In at least one configuration, instead of being coupled to the wall brackets 110, 120, 410 via fasteners, as described above, the splice apparatuses 150, 550, 650, 750, 850 can be instead glued to at least one of the wall brackets 110, 120, 410 via an adhesive or glue.

As is explained above, the wall brackets 110, 120, 410 can include members that are formed from a plurality of reinforcing fibers embedded within a resin matrix. The reinforcing fibers may comprise any number of different fibers in tows, fabrics, woven configurations or the like, and may comprise glass, carbon, kevlar, among other types of fibers. The resin matrix may comprise a thermoset resin, although other resins, such as thermoplastic resins are likewise contemplated, depending on the application. One common manner in which such first and second brackets 110, 120, 410 can be formed is through a pultrusion process, while cast processes, and additive processes, among others are likewise contemplated.

Additionally, and as set forth above, the first and second support members 110, 120, 410 are typically load bearing, and are thus made from a material that is able to support greater loads than the first and second wall brackets 110, 120, 410, such as wood and/or steel. As construction materials are subject to varying temperatures during use, with temperatures varying between seasons and varying due to heating and air conditioning, the first and second wall brackets 110, 120, 410 and the first and second support members 110, 120, 410 typically expand and contract at different rates such that at least one of the first and second wall brackets 110, 120, 410 can be subject to a cantilever movement(s) and/or relative movements.

In at least some configurations, the fasteners described herein extend through a hole that is larger than the shaft of the fastener to allow for relative movement between the first and second support members 110, 120 and first and second wall brackets 110, 120. Additionally, because of these temperature variations the first wall bracket 110 can be subject to relative movement (e.g., forward and back relative movement and/or upward and downward relative movement) with respect to the second wall bracket 120, these holes allow for expansion and contraction. These movement(s) not only impact the first and second wall brackets 110, 120, but also impact any building material(s) that is/are coupled to the first and second wall brackets 110, 120 which can cause deformation to those building material(s), and, in a worst case, detachment of those building material(s) from at least one of the first and second wall brackets 110, 120 if the movement(s) becomes great enough. The various wall brackets 110, 120, 410 disclosed herein at least mitigate such movement(s), and therefore at least mitigate such problems.

The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. A system, comprising:

a first wall bracket including a first end, a second end, a first side, and a second side on an opposite side of the first wall bracket from the first side, the first wall bracket to couple to a first support member;

a second wall bracket including a first end, a second end, a first side, and a second side on an opposite side of the second wall bracket from the first side of the second wall bracket, the second wall bracket to couple to a second support member, the first and second wall brackets comprising a composite material; and a splice apparatus includes a first end, a second end, a first side, and a second side on an opposite side of the splice apparatus from the first side of the splice apparatus, the first end of the splice apparatus disposed proximate to the second end of the first wall bracket and the second end of the splice apparatus disposed proximate to the first end of the second wall bracket;

wherein the splice apparatus is fastened to at least one of the first wall bracket and the second wall bracket to maintain substantial alignment of the first wall bracket with the second wall bracket;

wherein the first and second wall brackets comprise an upper member, a lower member, and an intermediate member perpendicularly coupled to the upper member and the lower member.

2. The system according to claim 1, wherein the splice apparatus comprises an upper member that corresponds to the upper member of the first and second wall brackets, an intermediate member that corresponds to the intermediate member of the first and second wall brackets, and a lower member that corresponds to the lower member of the first and second wall brackets, the upper member, and intermediate member, and the lower member of the splice apparatus being coupled to wrap around an entire perimeter of the first and second wall brackets.

3. The system according to claim 1, wherein the splice apparatus comprises a first curved portion, a second curved portion, and a straight portion coupled to the first curved portion and the second curved portion, the splice apparatus to slide onto the upper member of the first and second wall brackets without substantial space therebetween.

4. The system according to claim 1, wherein the splice apparatus comprises a first curved portion, a second curved portion, and a straight portion coupled to the first curved portion and the second curved portion, the splice apparatus to slide onto the lower member of the first and second wall brackets without substantial space therebetween.

5. The system according to claim 1, wherein the splice apparatus comprises at least one of aluminum and a composite material.

6. A method of maintaining substantial alignment of a first wall bracket with a second wall bracket via a splice apparatus, the method comprising:

coupling the first wall bracket to a first support member, the first wall bracket including a first end, a second end, a first side, and a second side on an opposite side of the first wall bracket from the first side, the first wall bracket to couple to a first support member;

coupling the second wall bracket to a second support member, the second wall bracket including a first end, a second end, a first side, and a second side on an opposite side of the second wall bracket from the first side of the second wall bracket, the second wall bracket to couple to a second support member, the first and second wall brackets comprising a composite material; and fastening a splice apparatus to at least one of the first wall bracket and the second wall bracket to maintain substantial alignment of the first wall bracket with the second wall bracket, the splice apparatus includes a first end, a second end, a first side, and a second side on an opposite side of the splice apparatus from the first side of the splice apparatus, the first end of the splice apparatus disposed proximate to the second end of the first wall bracket and the second end of the splice apparatus disposed proximate to the first end of the second wall bracket; and wherein the first and second wall brackets comprise an upper member, a lower member, and an intermediate member perpendicularly coupled to the upper member and the lower member.

7. The method according to claim 6, wherein the splice apparatus comprises an upper member that corresponds to the upper member of the first and second wall brackets, an intermediate member that corresponds to the intermediate member of the first and second wall brackets, and a lower member that corresponds to the lower member of the first and second wall brackets, the upper member, and intermediate member, and the lower member of the splice apparatus being coupled to wrap around an entire perimeter of the first and second wall brackets.

8. The method according to claim 6, wherein the splice apparatus comprises a first curved portion, a second curved portion, and a straight portion coupled to the first curved portion and the second curved portion, the splice apparatus to slide onto the upper member of the first and second wall brackets without substantial space therebetween.

9. The method according to claim 6, wherein the splice apparatus comprises a first curved portion, a second curved portion, and a straight portion coupled to the first curved portion and the second curved portion, the splice apparatus to slide onto the lower member of the first and second wall brackets without substantial space therebetween.

10. A splice apparatus, comprising:

a first end;

a second end;

a first side; and a second side disposed on an opposite side of the splice apparatus from the first side of the splice apparatus, with the first end of the splice apparatus to be disposed proximate to a second end of a first wall bracket and a second end of the splice apparatus to be disposed proximate to the first end of the second wall bracket;

wherein the first wall bracket includes a first end, the second end, a first side, and a second side on an opposite side of the first wall bracket from the first side, the first wall bracket to couple to a first support member; and wherein the second wall bracket includes a first end, the second end, a first side, and a second side on an opposite side of the second wall bracket from the first side of the second wall bracket, the second wall bracket to couple to a second support member, the first and second wall brackets comprising a composite material;

wherein:

the first and second wall brackets comprise an upper member, a lower member, and an intermediate member perpendicularly coupled to the upper member and the lower member; and the splice apparatus comprises an upper member that corresponds to the upper member of the first and second wall brackets, an intermediate member that corresponds to the intermediate member of the first and second wall brackets, and a lower member that corresponds to the lower member of the first and second wall brackets, the upper member, and intermediate member, and the lower member of the splice apparatus being coupled to wrap around an entire perimeter of the first and second wall brackets.

11. A splice apparatus, comprising:

a first end;

a second end;

a first side; and a second side disposed on an opposite side of the splice apparatus from the first side of the splice apparatus, with the first end of the splice apparatus to be disposed proximate to a second end of a first wall bracket and a second end of the splice apparatus to be disposed proximate to the first end of the second wall bracket;

wherein the first wall bracket includes a first end, the second end, a first side, and a second side on an opposite side of the first wall bracket from the first side, the first wall bracket to couple to a first support member; and wherein the second wall bracket includes a first end, the second end, a first side, and a second side on an opposite side of the second wall bracket from the first side of the second wall bracket, the second wall bracket to couple to a second support member, the first and second wall brackets comprising a composite material; and wherein:

the first and second wall brackets comprise an upper member, a lower member, and an intermediate member perpendicularly coupled to the upper member and the lower member; and the splice apparatus comprises a first curved portion, a second curved portion, and a straight portion coupled to the first curved portion and the second curved portion, the splice apparatus to slide onto the upper member of the first and second wall brackets without substantial space therebetween.

* * * * *